US012006111B2

(12) United States Patent
Greenberg et al.

(10) Patent No.: US 12,006,111 B2
(45) Date of Patent: Jun. 11, 2024

(54) PACKAGING COMPRISING A CONTAINER AND A CAP WITH HINGED LID

(71) Applicant: Société des Produits Nestlé S.A., Vevey (CH)

(72) Inventors: Kelly Greenberg, South Orange, NJ (US); Richard Jentis, Bridgewater, NJ (US); Tran Nguyen, Monroe Township, NJ (US); Jeff Wolford, St. Louis Park, MN (US)

(73) Assignee: Societe des Produits Nestle S.A., Vevey (CH)

( * ) Notice: Subject to any disclaimer, the term of this patent is extended or adjusted under 35 U.S.C. 154(b) by 253 days.

(21) Appl. No.: 16/533,196

(22) Filed: Aug. 6, 2019

(65) Prior Publication Data

US 2019/0359395 A1 Nov. 28, 2019

Related U.S. Application Data

(63) Continuation of application No. 14/370,670, filed as application No. PCT/EP2013/050054 on Jan. 3, 2013, now abandoned.

(60) Provisional application No. 61/584,007, filed on Jan. 6, 2012.

(51) Int. Cl.

| | |
|---|---|
| ***B65D 43/00*** | (2006.01) |
| ***B65D 43/02*** | (2006.01) |
| ***B65D 47/00*** | (2006.01) |
| ***B65D 47/08*** | (2006.01) |
| ***B65D 51/10*** | (2006.01) |
| ***B65D 51/18*** | (2006.01) |
| ***B65D 83/00*** | (2006.01) |
| ***B65D 83/06*** | (2006.01) |

(52) U.S. Cl.

CPC ..... *B65D 51/18* (2013.01); *B65D 43/0202* (2013.01); *B65D 43/0231* (2013.01); *B65D 47/0895* (2013.01); *B65D 83/06* (2013.01)

(58) Field of Classification Search

CPC ..... B65D 47/265; B65D 47/286; B65D 47/0847; B65D 47/0861; B65D 47/0866; B65D 47/0895; B65D 83/06; B65D 51/18; B65D 43/0202; B65D 43/0231; B65D 39/00; B65D 41/00; B65D 4343/0231; A47G 19/24; A47J 43/27

See application file for complete search history.

(56) References Cited

U.S. PATENT DOCUMENTS

| | | | |
|---|---|---|---|
| 3,322,308 | A | 5/1967 | Foster |
| 5,145,080 | A | 9/1992 | Imbery, Jr. |
| 5,201,440 | A | 4/1993 | Gross |

(Continued)

FOREIGN PATENT DOCUMENTS

| | | |
|---|---|---|
| CN | 201362420 | 12/2009 |
| WO | 2010093755 | 8/2010 |

*Primary Examiner* — Ericson M Lachica

(74) *Attorney, Agent, or Firm* — K&L Gates LLP

(57) ABSTRACT

A packaging for dispensing infant food products is disclosed. In a general embodiment, the present disclosure provides a packaging for infant cereal products. The packaging includes a cap having a hinged lid attached to the cap, and a container releasably attachable to the cap. The cap is removable from the container to allow the removal of a desired amount of product in the container. The hinged lid is also openable so that a desired amount of product can be poured there through.

7 Claims, 4 Drawing Sheets

(56) References Cited

U.S. PATENT DOCUMENTS

| | | | | |
|---|---|---|---|---|
| 5,884,800 | A | 3/1999 | Hall | |
| 6,341,720 | B1 * | 1/2002 | Schmit | B65D 47/046 222/480 |
| 6,510,971 | B1 | 1/2003 | Martin | |
| 6,655,544 | B1 | 12/2003 | Tanaka et al. | |
| 6,761,279 | B1 | 7/2004 | Martin et al. | |
| 7,694,845 | B2 | 4/2010 | Tilton | |
| 8,567,638 | B2 | 10/2013 | Bandoh et al. | |
| 2002/0185464 | A1 | 12/2002 | Luker | |
| 2004/0206757 | A1 | 10/2004 | Hall et al. | |
| 2005/0023304 | A1 | 2/2005 | Vogel et al. | |
| 2005/0242095 | A1 | 11/2005 | Serrano et al. | |
| 2005/0263523 | A1 | 12/2005 | Moss | |
| 2006/0096984 | A1 | 5/2006 | Bandoh et al. | |
| 2006/0150828 | A1 | 7/2006 | Quackenbush et al. | |
| 2006/0186075 | A1 | 8/2006 | Rainey et al. | |
| 2007/0196542 | A1 * | 8/2007 | Rathbone | A23G 3/563 426/106 |
| 2007/0284372 | A1 | 12/2007 | Gnepper | |
| 2008/0050490 | A1 | 2/2008 | Stalder et al. | |
| 2008/0110942 | A1 * | 5/2008 | Blomdahl | B65D 43/161 222/556 |
| 2008/0262930 | A1 | 10/2008 | Miceli et al. | |
| 2009/0123610 | A1 | 5/2009 | Mullin | |
| 2009/0223985 | A1 | 9/2009 | Carmody et al. | |
| 2010/0059519 | A1 | 3/2010 | Brozell et al. | |
| 2010/0072100 | A1 | 3/2010 | Henry et al. | |
| 2011/0042401 | A1 | 2/2011 | Rathbone et al. | |
| 2011/0139655 | A1 | 6/2011 | Cochran et al. | |
| 2011/0284550 | A1 | 11/2011 | Gersovitz | |
| 2013/0341329 | A1 | 12/2013 | Adler et al. | |

* cited by examiner

PACKAGING COMPRISING A CONTAINER AND A CAP WITH HINGED LID

CROSS REFERENCE TO RELATED APPLICATIONS

The present application is a continuation of U.S. application Ser. No. 14/370,670, filed Jul. 3, 2014, which claims priority to National Stage of International Application No. PCT/EP2013/050054, filed on Jan. 3, 2013, which claims priority to U.S. Provisional Patent Application No. 61/584,007, filed Jan. 6, 2012, the entire contents of which are being incorporated herein by reference.

BACKGROUND

The present disclosure relates generally to a cap and container packaging. More specifically, the present disclosure relates to having a cap having a hinged lid attached to a container.

Packaging for consumable products come in a variety of sizes, shapes, materials and designs. These sizes, shapes, materials and designs generally differ, for example, for aesthetic reasons. Although consumable product packaging may be provided to enhance aesthetic qualities of packages, the purposes for consumable product packaging are not limited to only this purpose.

Packaging holding particulate, granular or powdered materials is commonly known. Examples of such containers include powdered infant formula and coffee. Nonetheless, there is a need to provide an improved packaging for simply and efficiently administering particulate material from a container.

SUMMARY

The present disclosure relates to a cap and container packaging. The packaging can be used to dispense infant cereal products, which may be in the form of particulate and powder materials. In a general embodiment, the present disclosure provides a packaging for infant cereal products. The packaging includes a cap having a hinged lid attached to the cap, and a container releasably attachable to the cap. The cap is removable from the container to allow removal of a desired amount of product in the container using, for example, a spoon or a scoop. In addition, the hinged lid is openable so that a desired amount of product can be poured therethrough.

In an embodiment, the container is in the shape of a rectangular cuboid, and the four opposing sides are recessed.

In an embodiment, the container has rounded corners.

In an embodiment, at least one of the cap and the container is made from polyethylene terephthalate.

In an embodiment, the cap includes a threaded portion that is threadingly attachable to a threaded portion of the container.

In an embodiment, the packaging includes an infant cereal product.

In another embodiment, the present disclosure provides a packaging for administrating particulate material. The packaging includes a cap having a base panel, four side panels extending from the base panel, and a threaded portion extending from a bottom of the base panel. The base panel defines a hole therethrough. A hinged lid is attached to the cap. The packaging further includes a container that is releasably attachable to the cap. The container includes a top panel, a bottom panel and four side panels extending between the top panel and the bottom panel. The top panel defines a hole therethrough.

In an embodiment, the base panel of the cap includes a recessed portion that is so constructed and arranged to accommodate the hinged lid therein.

In an embodiment, one of the side panels of the cap includes a recessed portion.

In an embodiment, the hinged lid includes an extended sealing wall that conforms to a border of the hole of the cap.

In an embodiment, the four side panels of the container are recessed.

In an embodiment, the cap has rounded corners.

In an embodiment, the container has rounded corners.

In an embodiment, at least one of the cap and the container is made from polyethylene terephthalate.

In an embodiment, the packaging includes an infant cereal product stored therein.

An advantage of the present disclosure is to provide a packaging that is convenient and easy to use.

Another advantage of the present disclosure is to provide a cap and container packaging having an easy to pour functionality.

Yet another advantage of the present disclosure is to provide a cap and container packaging for particulates or powders whereby users can easily access the contents of the packaging using a spoon or other administering utensil.

Still another advantage of the present disclosure is to provide a packaging for particulate material that prevents or minimizes potential contamination of the material by the user.

Additional features and advantages are described herein, and will be apparent from, the following Detailed Description and the figures.

DETAILED DESCRIPTION

Figure 1:
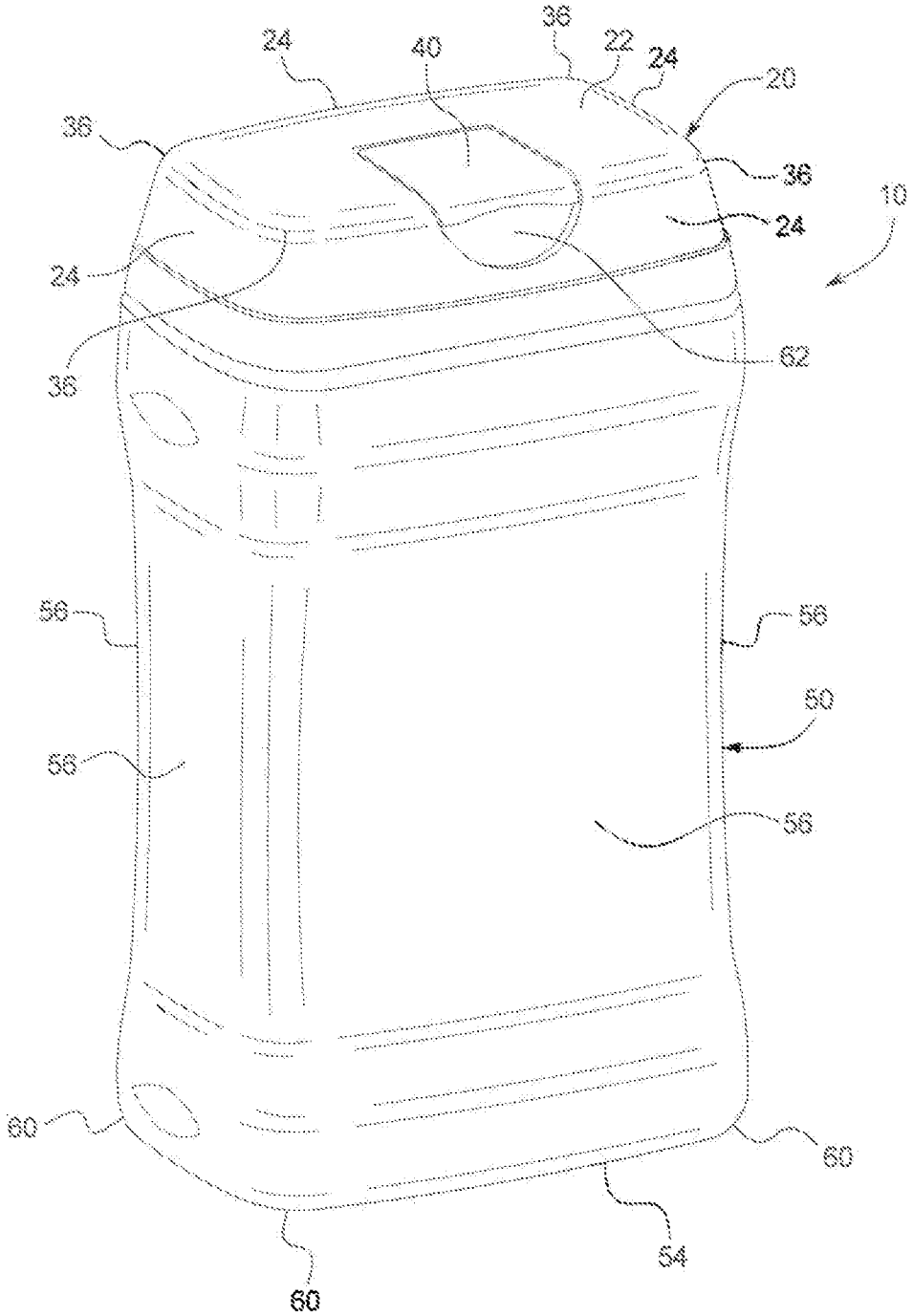
FIG. 1 is a perspective view of an embodiment of the packaging of the present disclosure illustrating the cap and the container with the hinged lid in a closed position.

The present disclosure relates to packaging. More specifically, the present disclosure relates to a cap and container packaging for dispensing, administering or proportioning suitable food products, for example, in the form of particulate, granular and powder materials from the packaging containing same. The materials can be any of a variety of dispensable materials such as, for example, baby formula, powdered beverages, flour, coffee, sugar, etc. It should be appreciated that the cap and container packaging can be adapted for dispensing or administering liquids or viscous materials as well.

In an embodiment illustrated in FIGS. 1-4, the present disclosure provides a packaging 10 for administrating a consumable product such as a particulate material. Packaging 10 includes a cap 20 having a base panel 22, four side panels 24 extending from base panel 22, and a threaded portion 26 extending from a bottom side 28 of base panel 22. Base panel 22 defines a hole 30 therethrough for the consumable product to pass through. Hole 30 can be any suitable shape and size to accommodate a desired amount of food to be poured through by a user. A hinged lid 40 is attached to cap 20 and can hingedly open and close to cover hole 30 of base panel 22. Packaging 10 further includes a container 50 that is releasably attachable to cap 20.

Figure 3:
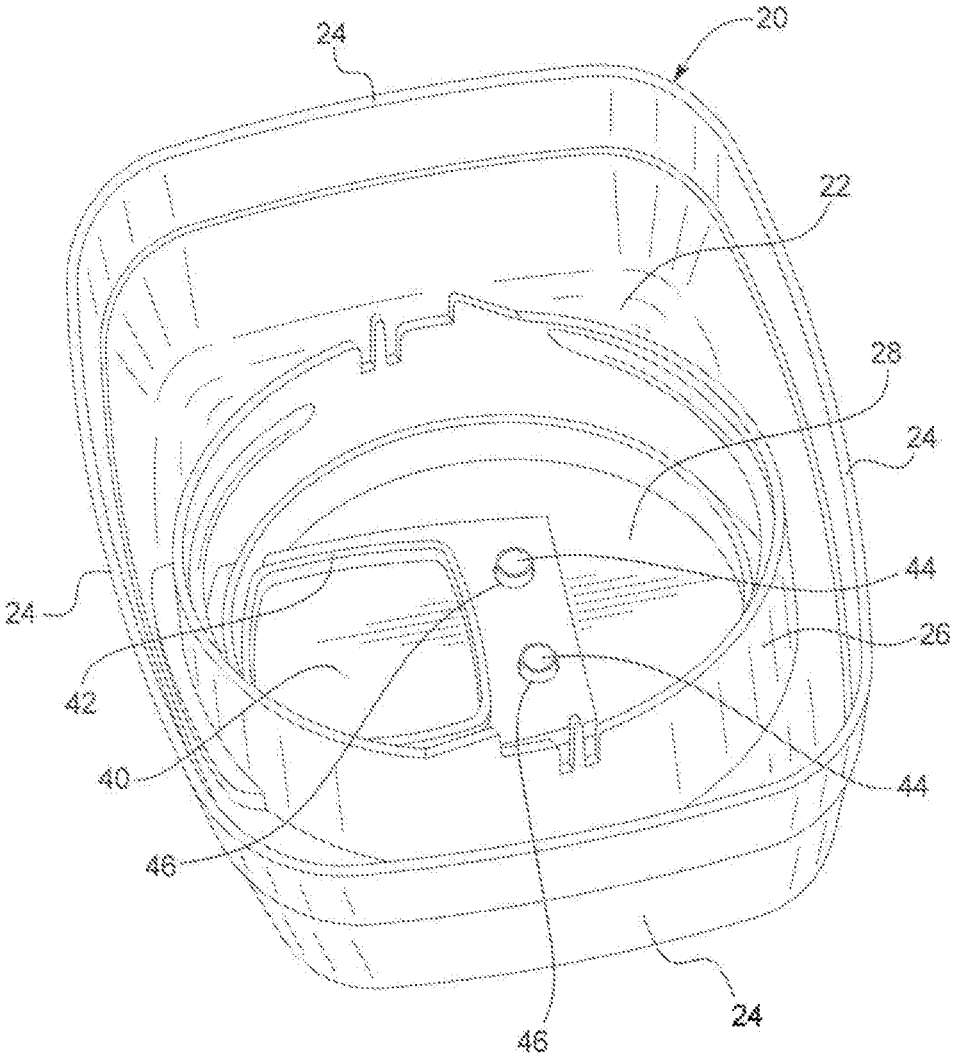
FIG. 3 is a bottom perspective view of the cap.

Hinged lid 40 can be attached to base panel 22 of cap 20 using any suitable mechanism. For example, hinged lid 40 can include one or more pegs 44 that fit into one or more slots 46 of base panel 22 as shown in FIG. 3 (e.g., via a snap fit). Hinged lid 40 can then be hingedly opened and closed with respect to cap 20.

Figure 2:
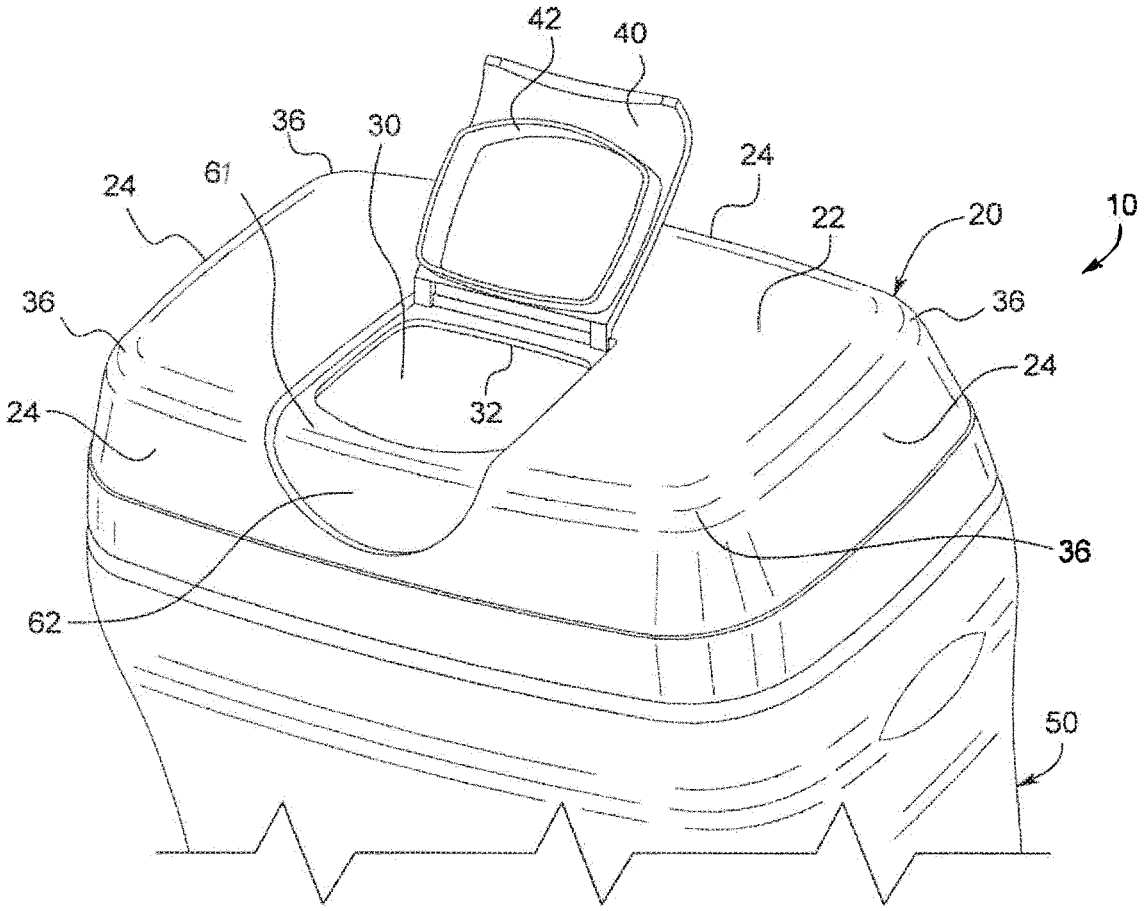
FIG. 2 is a perspective view of an embodiment of the packaging of the present disclosure illustrating the cap and the container with the hinged lid in an open position.

As shown in FIG. 2, base panel 22 of cap 20 can include a recessed portion 60-61 that is so constructed and arranged to accommodate hinged lid 40 therein. The shape of recessed portion 60-61 can match the shape of hinged lid 40. For example, recessed portion 60-61 allows hinged lid 40 to be fit within base panel 22 so that no portion of hinged lid 40 is above cap 20 when hinged lid 40 is in a closed position as shown in FIG. 1. Cap 20 can also include rounded corners 36. These features provide improved aesthetics to packaging 10.

Side panels 24 can be tapered outwardly from base panel 22 of cap 20. As further shown in FIGS. 1-2, one of side panels 24 (e.g., a front panel) of cap 20 can include a recessed portion 62. Recessed portion 62 allows a user to more easily access and open hinged lid 40. Hinged lid 40 can include an extended sealing wall 42 that conforms to a border or edge 32 of hole 30 of cap 20. This provides an additional sealing mechanism to keep the contents of packaging 10 from leaking out of hinged lid 40 when hinged lid 40 is in the closed position.

Figure 4:
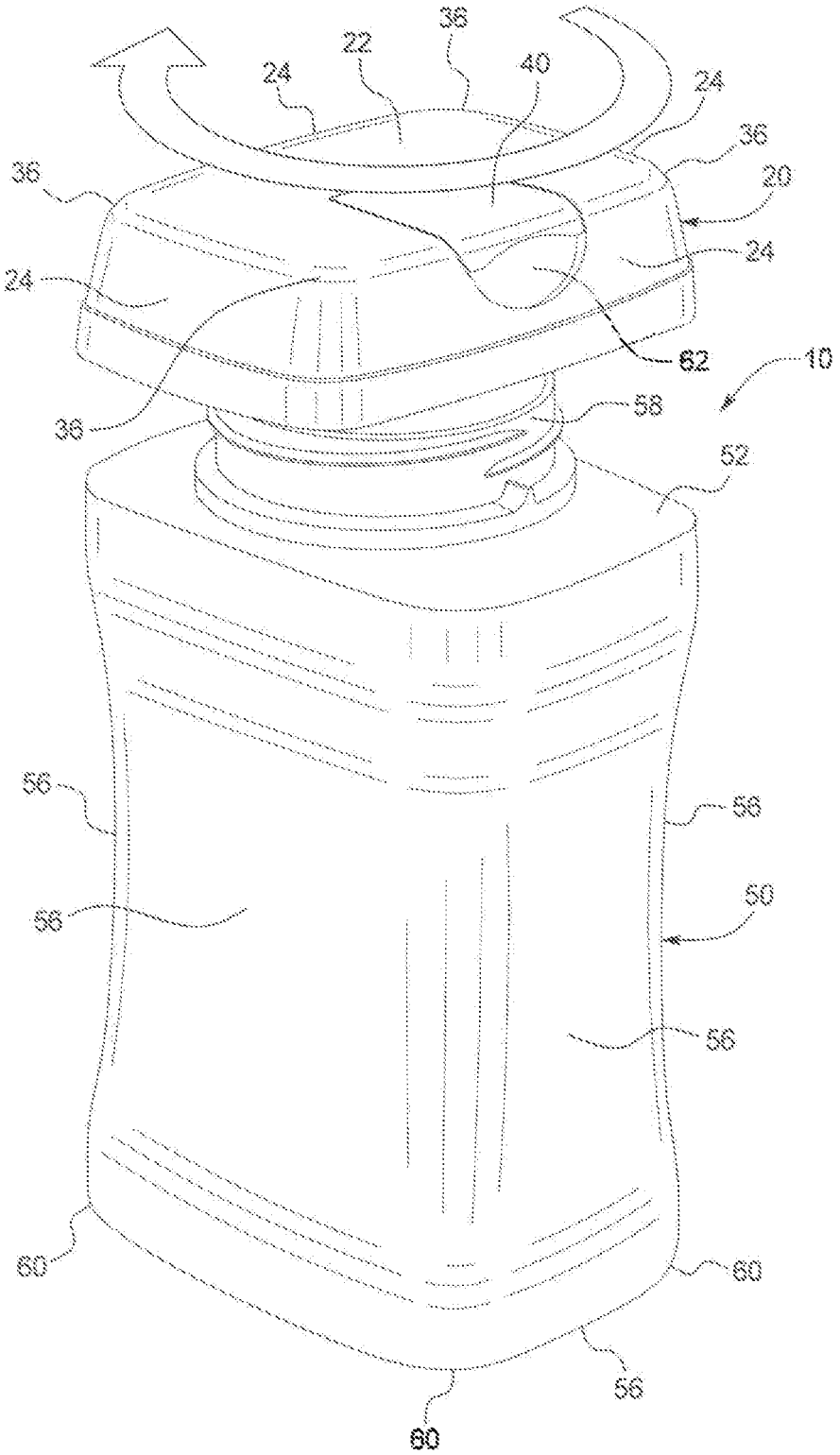
FIG. 4 is a perspective view of the cap and container packaging with the cap twisted off

Container 50 includes a top panel 52, a bottom panel 54 and four side panels 56 extending between top panel 52 and bottom panel 54. Top panel 52 includes a threaded portion 58 extending from top panel 52 that defines a hole in which a product in container 50 can be poured through. Threaded portion 58 of container 50 should match threaded portion 26 of cap 20 so that cap 20 can be twisted off of container 50 as shown in FIG. 4. Cap 20 is therefore removable from container 50 to allow the removal of a desired amount of product in container 50. Alternatively, hinged lid 40 is openable so that a desired amount of product can be poured therethrough by a user.

Container 50 defines an interior compartment (not shown). Although the panels 52, 54 and 56 of container 50 are illustrated as being substantially rectangular in shape, panels 52, 54 and 56 of container 50 may define any shape that is known in the art. For example, panels 52, 54 and 56 may be square, rectangular, oval (e.g., oblong), triangular, etc., so long as container 50 is capable of housing a consumable product within an interior compartment. For ease of reference, and with this embodiment, container 50 is a rectangular body as shown in FIG. 1.

As further shown in FIGS. 1 and 4, one or more of the four side panels 56 of container 50 are recessed. This not only provides an aesthetically pleasing design, but also allows a user to grab container 50 more easily for handling and pouring. Container 50 can also include rounded corners 60.

Cap 20 is sized and shaped to fit with container 50. Container 50 is not limited to any particular size so long as consumable products may be contained therein and may be easily handled by a user. The dimensions of cap 20 and container 50 can be such that they have identical or substantially similar peripheral shapes so as to make packaging 10 appear as a cohesive unit as shown in FIG. 1. The skilled artisan will appreciate that the dimensions of cap 20 and container 50 may vary as desired or in accordance with manufacturing specifications or in accordance with the size and shape of the consumable products contained therein.

Cap 20 is not limited to any particular shape or size, so long as cap 20 is capable of sealingly fitting to container 50 to prevent loss or contamination of a consumable product housed therein. In alternative embodiments, besides using threaded portions 26 and 58, cap 20 may be mated with container 50 by snap-fitting, pressure-fitting, friction fitting, etc. Cap 20 may be fitted to container 50 in a resealing manner so that each time cap 20 is removed from container 50, it may be placed on container 50 again in a sealed manner.

The surface of cap 20 and/or container 50 can include any suitable gripping textures or portions. The gripping texture or portions may be, for example, a rough surface or dimple grips and may have a shape such as a circle, square, rectangle, triangle, quadrilateral, pentagon, hexagon, heptagon, octagon, nonagon, decagon, hexadecagon, icosagon, star, ellipse, semicircle, crescent, flower, or combinations thereof.

Packaging 10 can include any indicia or instructions printed on a surface of cap 20 and/or container 50. The indicia may include, for example, colors, numbers, letters, logos, advertisements, branding information, nutritional information, product information, manufacturer information, etc. The indicia may be printed on a pressure sensitive material, printed directly on cap 20 and/or container 50, printed on a removable closure, attached as a sticker, etc. The indicia may be placed on cap 20 and/or container 50 by a method such as embossing, debossing, printing, engraving, a sticker, or combinations thereof The instructions can depict or describe, for example, how to serve or administer the contents of packaging 10.

Cap 20 and container 50 can be made from any suitable materials such as polymers, plastics or other synthetic materials. For example, cap 20 and/or container 50 can be made from a polyethylene material such as linear low density polyethylene or a suitable polypropylene. In a preferred embodiment, cap 20 and/or container 50 is made from polyethylene terephthalate.

Cap 20 and/or container 50 may be formed using conventional thermoforming or molding processes including, but not limited to, injection molding, injection blow molding and extrusion blow molding. Alternatively, cap 20 and/or container 50 may be manufactured from non-plastic materials including, but not limited to, cardboard, metal, Styrofoam, etc.

In alternative embodiments, any suitable portion of cap 20 and/or container 50 can be either transparent or translucent so that a consumer can readily discern what types of products are housed in packaging 10. Alternatively, at least a portion of cap 20 and/or container 50 may be opaque. Cap 20 may be manufactured from a same or different material as container 50 and may be translucent while container 50 is opaque, or vice versa.

In an embodiment, packaging 10 includes a nutritional product such as an infant cereal product stored therein. The nutritional product or infant cereal product, for example, can include any suitable ingredients such as a starch source and/or a protein source. Suitable starch sources are, for example, grains such as corn, rice, wheat, beets, barley, oats, soy, and mixtures of these. Suitable protein sources may be selected from any suitable animal or vegetable protein source including, for example, meat meal, bone meal, fish meal, soy protein concentrates, milk proteins, gluten, and the like. The choice of the starch and protein sources will be largely determined by the nutritional needs of the infant, palatability considerations, and the type of cereal product produced. Various other ingredients, for example, sugar, salt, spices, seasonings, vitamins, minerals, flavoring agents, fats and the like may also be incorporated into the infant cereal product as desired.

The nutritional product or infant cereal product can include fat sources such as canola oil, corn oil, palm olein, high oleic sunflower oil and high oleic safflower oil. The essential fatty acids linoleic and a-linolenic acid may also be added as may small amounts of oils containing high quantities of preformed arachidonic acid and docosahexaenoic acid such as fish oils or microbial oils.

The nutritional product or infant cereal product can further include a suitable carbohydrate such as, for example, sucrose, lactose, glucose, fructose, corn syrup solids, saccharose, maltodextrins, starch and mixtures thereof Dietary fiber may also be added if desired. Dietary fiber passes through the small intestine undigested by enzymes and functions as a natural bulking agent and laxative. Dietary fiber may be soluble or insoluble or a blend of the two types. Suitable sources of dietary fiber include soy, pea, oat, pectin, guar gum, gum arabic, fructooligosaccharides and galacto-oligosaccharides.

The nutritional product or infant cereal product can also include minerals and micronutrients such as trace elements and vitamins. Examples of minerals, vitamins and other micronutrients optionally present in the nutritional compositions include vitamin A, vitamin B1, vitamin B2, vitamin B6, vitamin B12, vitamin E, vitamin K, vitamin C, vitamin D, folic acid, inositol, niacin, biotin, pantothenic acid, choline, calcium, phosphorous, iodine, iron, magnesium, copper, zinc, manganese, chloride, potassium, sodium, selenium, chromium, molybdenum, taurine, and L-camitine. Minerals are usually added in salt form.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of providing a nutritional product to an infant, the method comprising:

(i) removing a portion of the nutritional product from a container with a cap detached from the container, the cap comprising a base panel, four cap side panels extending from the base panel, and a circular threaded portion extending from a bottom of the base panel, the base panel having a substantially rectangular cross section and defining a hole therethrough, the circular threaded portion circumscribing the hole in the base panel;

a hinged lid attached to the cap, the hinged lid comprising a first portion coplanar with the base panel and a second portion coplanar with one of the four cap side panels when the hinged lid covers the hole, the cap comprising a recessed portion constructed and arranged to accommodate the first and the second portions of the hinged lid therein, and the recessed portion continuously extending from the base panel of the cap into the one of the four cap side panels of the cap with which the second portion of the hinged lid is coplanar; and the container containing the nutritional product, the container releasably attachable to the cap, the cap being removable from the container to allow a removal of a desired amount of the nutritional product in the container, and the hinged lid being openable so that a desired amount of the nutritional product can be poured therethrough, the container comprising a top panel, a bottom panel and four container side panels extending between the top panel and the bottom panel, the top panel defining a hole therethrough, the container being in a shape of a rectangular cuboid, and the four container side panels are recessed, the circular threaded portion of the cap is threadingly attachable to a circular threaded portion of the container, the circular threaded portion of the container extends from the top panel and defines the hole through the top panel, and the top panel is a rectangular surface extending from the circular threaded portion to the four container side panels, the container is configured to move between (a) an open configuration wherein the cap is detached from the container and (b) a closed configuration wherein the container is completely sealed by the cap, wherein dimensions of the cap and the container are such that the cap and the container have identical peripheral shapes so as to appear as a cohesive unit when the container has the closed configuration, the top panel of the container has a generally rectangular perimeter where the top panel of the container contacts the four cap side panels extending from the base panel of the cap when the container has the closed configuration, and the top panel of the container extends from the circular threaded portion of the container to the generally rectangular perimeter;

(ii) attaching the cap to the container, wherein the circular threaded portion of the cap is threadingly attached to the circular threaded portion of the container;

(iii) opening the hinged lid via the recessed portion; and (iv) removing another portion of the nutritional product through the hole in the top panel of the container while the cap is attached to the container.

2. The method of claim 1, wherein the hinged lid comprises an extended sealing wall that conforms to a border of the hole of the cap.

3. The method of claim 1, wherein the cap has rounded corners.

4. The method of claim 1, wherein the container has rounded corners.

5. The method of claim 1, wherein at least one of the cap or the container is made from polyethylene terephthalate.

6. The method of claim 1, wherein the container is transparent.

7. The method of claim 1, wherein the hinged lid comprises one or more pegs, and the base panel comprises one or more slots.

* * * * *